US006356872B1

(12) United States Patent
Leung et al.

(10) Patent No.: US 6,356,872 B1
(45) **Date of Patent: *Mar. 12, 2002**

(54) METHOD AND APPARATUS FOR STORING DIGITAL AUDIO AND PLAYBACK THEREOF

(75) Inventors: Ka Yin Leung, Austin; Eric J. Swanson, Buda; Kafai Leung, Austin, all of TX (US)

(73) Assignee: Crystal Semiconductor Corporation, Austin, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/719,986

(22) Filed: Sep. 25, 1996

(51) Int. Cl.[7] ..... G10L 21/00
(52) U.S. Cl. ..... 704/503; 704/229
(58) Field of Search ..... 704/201, 226, 704/229, 230, 500, 503, 504; 341/155

(56) References Cited

U.S. PATENT DOCUMENTS

| | | | | |
|---|---|---|---|---|
| 4,564,918 A | | 1/1986 | McNally et al. | 702/79 |
| 4,716,472 A | | 12/1987 | McNally | 360/8 |
| 4,748,578 A | | 5/1988 | Lagadec et al. | 708/313 |
| 4,772,871 A | | 9/1988 | Suzuki et al. | 341/155 |
| 4,780,892 A | | 10/1988 | Lagadec | 375/371 |
| 4,825,398 A | | 4/1989 | Koch et al. | 708/313 |
| 4,943,807 A | | 7/1990 | Early | 341/120 |
| 5,204,677 A | | 4/1993 | Akagiri et al. | 341/118 |
| 5,257,026 A | | 10/1993 | Thompson et al. | 341/118 |
| 5,774,842 A | * | 6/1998 | Nishio et al. | 704/226 |
| 5,864,800 A | * | 1/1999 | Imai et al. | 704/229 |

OTHER PUBLICATIONS

Robert Adams and Tom Kwan, "Theory and VLSI Architectures for Asynchronous Sample–Rate Converters," *J. Audio Eng. Soc.*, vol. 41, No. 7/8, Jul./Aug.

(List continued on next page.)

*Primary Examiner*—Patrick N. Edouard
(74) *Attorney, Agent, or Firm*—Steven Lin

(57) ABSTRACT

A data conversion device is provided for storing digital data in a DAT (332) at a 16-bit word length and then recovering the data at a 24-bit word length with an overall reduction in truncation noise that would be inherently associated with data at the 16-bit word length. This is facilitated by noise shaping the data at the 16-bit word length prior to storage in the DAT (332) with a noise-shaping filter (324). This results in truncation noise in the lower portion of the frequency band being shifted to the higher portion of the band. When the data is recovered, it is converted to a 24-bit word length and then processed through a bandpass filter to filter out the higher frequency noise to yield a signal that has a maximum noise equal to or less than that in the lower portion of the band stored in the DAT (332). Since the truncation noise was shifted from the lower band to the upper band, this is a lower noise level than that inherently associated with the 16-bit word length.

38 Claims, 12 Drawing Sheets

OTHER PUBLICATIONS

Robert Adams and Tom Kwan, "A Stereo Asynchronous Digital Sample–Rate Converter for Digital Audio," *IEEE Journal of Solid–State Circuits*, vol. 29, No. 4, Apr. 1994.

"Advance Information: DSP56ADC16 16–Bit Sigma–Delta Analog–to–Digital Converter," Motorola, Inc., 1989.

M. S. Ghausi and K. R. Laker, "Modern Filter Design," by Bell Telephone Laboratories, Inc., pp. 342–357, 1981.

R. W. Adams, P. F. Ferguson, Jr., A. Fanesan, S. Vincelette, A. Volpe, and R. Libert, "Theory and Practical Implementation of a Fifth–Order Sigma–Delta A/D Converter," *J. Audio Eng. Soc.*, vol. 39, nos. 7–8, pp. 515–527, Jul./Aug. 1991.

S. A. Jantzi, W. M. Snelgrove, and P. F. Ferguson, Jr., "A Fourth–Order Bandpass Sigma–Delta Modulator," *IEEE Journal of Solid–State Circuits*, vol. 28, No. 3, pp. 282–291, Mar. 1993.

R. Gregorian and G. C. Temes, "Analog MOS Integrated Circuits for Signal Processing," *A Wiley–Interscience Publication*, John Wiley and Sons, pp. 265–401, 1986.

Lawrence R. Rabiner, Bernard–Gold, "Theory and Application of Digital Signal Processing", pp. 328–329.

Charles D. Thompson, Salvador R. Bernadas, "A Digitally–Corrected 20b Delta–Sigma Modulator", 1994 IEEE International Solid–State Circuits Conference, pp. 194–195.

Y.Matsuya, K.Uchimura, A.Iwata, T.Kobayashi, "A 16–bit Oversampling A–to–D Conversion Technology Using Triple–Integration Noise Shaping", IEEE Journal of Solid–State Circuits, vol. SC–22, 12/87, pp. 921–928.

Mehdi Hatamiam and Keshab K. Parhi, "An 85–MHz Fourth–Order Programmable IIH Digital Filter Chip", IEEE Journal of Solid–State Circuits, vol. 27, No. 2, 2/92, pp. 175–183.

David Vallancourt and Yannis P. Tsividis "A Fully Programmable Sampled–Data Analog CMOS Filter with Transfer–Function Coefficient Determined by Timing", IEEE Journal of Solid–State Circuits, vol. SC–22, No. 6, 12/87, pp. 1022–1030.

Kin Lin and John Poulos, "Area Efficient Decimation Filter for an 18–bit Delta–Sigma Analog–to–Digital Convert", AES 2/95, pp. 1–10.

Alan V. Oppenheim and Alan S. Willsky, "Signals and Systems", Analysis and Characterization of LTI Systems Using z–Transforms, Sec. 10.7, 1983.

David Vallancourt and Yannis P. Tsividis, "Timing–Controlled Fully Programmable Analog Signal Processors Using Switched Continuous–Time Filters", IEEE Transactions on Circuits and Systems, vol. 35, No. 8, 8/88, pp. 947–954.

1994 Crystal Semiconductor Audio Databook, pp. 3–143.

DSP56000/DSP56001 Digital Signal Processor User's Manual, Rev. 2, pp. 11–18–11–19, 1990.

Texas Instruments TMS320C3x User's Guide, 1992, pp. 8–12–8–16.

Andreas Antoniou, "Digital Filters", Second Edition, 1993, pp. 366–381.

Robert A. Wannamaker, "Psychoacoustically Optimal Noise Shaping", Audio Research Group, University of Waterloo, Ont. N2L 3G1, Canada, Presented at the 89th convention of the Audio Engineering Society 1990; revised 1992.

Michael Gerzon and Peter G. Craven, "Optimal Noise Shaping and Dither of Digital Signals", An Audio Engineering Society Preprint, Presented at the 87th Convention 1989 Oct. 18–21.

* cited by examiner

METHOD AND APPARATUS FOR STORING DIGITAL AUDIO AND PLAYBACK THEREOF

CROSS-REFERENCE TO RELATED APPLICATIONS

This application is related to U.S. patent application Ser. No. 08/413,356, filed Mar. 30, 1995, and entitled, "DIGITAL FILTER WITH DECIMATED FREQUENCY RESPONSE" and U.S. patent application Ser. No. 08/416,618, filed Apr. 5, 1995, and entitled "MULTIPLE FUNCTION ANALOG-TO-DIGITAL CONVERTER WITH MULTIPLE SERIAL OUTPUTS".

TECHNICAL FIELD OF THE INVENTION

The present invention pertains in general to analog-to-digital converters, and more particularly, to the use of the digital filter section to process and store digital audio on a digital storage media.

BACKGROUND OF THE INVENTION

Analog-to-digital converters have seen increased use in the audio industry. Due to the increased level of sophistication in the processing of analog information, digital techniques have been utilized to process this analog information. By converting the analog signal into a digital signal and utilizing available digital processing techniques, a higher degree of versatility is provided to the user. This digital processing is utilized to process the information in order to provide various types of outputs after processing. One type of output is a fairly high filtered output that is typically provided by a digital filtering process that requires a very sharp filter response with minimal aliasing. This type of filter, unfortunately, has a significant group delay associated therewith, due to the fact that this type of filter requires a relatively long Finite Impulse Response (FIR) filter. While this is necessary to provide a high quality sound recording, the group delay can present a problem with respect to an artist listening to the soundtrack while it is being recorded. In order to achieve a lower group delay, a much shorter filter with less taps is required, which inherently has a poor filter response.

Other types of processing that can be provided are, for example, a psycho-acoustic filter that shapes the noise response of a given filter output to minimize the noise in the portion of the spectrum associated with the optimum response of the human ear, i.e., approximately 2 KHz, and then increase the noise level above and below that frequency. These types of filters are very useful when a conversion from a high resolution digital output to a low resolution digital output is needed. This noise shaping is directed toward the truncation noise that is related to processing at one word length and then reducing the word length by truncating bits. This filtering does not shape the background noise.

At present, all the above functions require separate processing systems, most of which are not compatible with each other. This presents a disadvantage to the user in that the user must utilize separate systems for the separate functions and is not provided an easy means to facilitate the different systems.

Another aspect of utilizing data conversion devices in audio applications is the requirement for the data conversion device to operate at higher frequencies. Due to the advent of digital storage devices such as the Digital Audio Tape (DAT) and the Digital Video Disk (DVD), the sampling rate of the digital data has been increased, as it is believed that the higher sampling rate allows ultrasonic information to be stored. For example, the sampling rate is now at 96 KHz as compared to previous Compact Disk (CD) formats that have sampling rates slightly above 40 KHz. The result of this is that the $f_s/2$ frequency of 48 KHz is well outside the audio range of most individuals. With the prior CD formats, the $f_s/2$ frequency of slightly greater than 20 KHz could be heard by some individuals.

In order to insure that the noise performance of a 48 KHz sampling rate signal derived from a 96 MU sampling rate signal stored in a digital media was unchanged was to insure that the noise floor at the 96 KHz sampling rate was the same as the noise floor at the 48 KHz sampling rate. Therefore, the bit resolution at the 96 KHz sampling rate had to be maintained as that at the 48 KHz sampling rate, i.e., considerable storage would therefore be required.

SUMMARY OF THE INVENTION

The present invention disclosed and claimed herein comprises a method and apparatus for storing data on a digital audio media and then retrieving the audio data in a playback operation. The audio input signal is converted to a digital audio signal at a first sampling rate and at a first word length and having a defined frequency band of operation. This digital audio signal is then noise shaped to shift noise from a low portion of the frequency band thereof to a higher portion of the frequency band thereof. This noise-shaped digital audio signal has a smaller and second word length at a first sampling rate and is then stored on the digital audio media. Thereafter, the stored noise-shaped digital audio signal is retrieved and then converted to the first word length at a second and lower sampling rate. The conversion is done by filtering the data with a digital filter to remove the shifted noise in the higher portion of the frequency band and decimating it to the second sampling rate. This filtered digital audio signal is then input to a digital-to-analog converter operating at the second sampling rate.

In another aspect of the present invention, the noise-shaped digital audio signal can be coupled directly to the digital-to-analog converter, which is operated at the first sampling rate and at the second word length.

In a yet further aspect of the present invention, the step of converting the analog audio signal to a digital audio signal involves processing the signal through an analog modulator and then through a digital decimation filter. The digital filter operates at the first sampling rate but at the second word length. After filtering and decimation, the signal is noise shaped at the first word length prior to the truncation to the second word length, the noise being shaped being the truncation noise. The filter operation is multiplexed, such that the digital filter utilized to filter the output of the analog modulator can be utilized to filter the retrieved converted noise-shaped digital audio signal. Since the digital filter performs a filtering and decimation operation, both steps can be performed therein.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
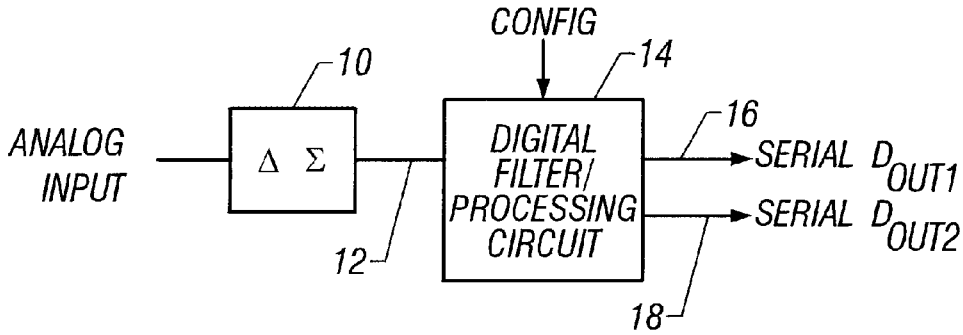
FIG. 1 illustrates an overall block diagram of the data conversion system utilized with the present invention.

Referring now to FIG. 1, there is illustrated an overall block diagram of the present invention. An analog input is received on the input of an analog modulator 10. The analog modulator 10 in the preferred embodiment is a delta-sigma analog modulator. The analog modulator 10 is operable to receive the analog signal on the input thereof and convert it to a digital string of ones and zeroes, this being a 1-bit stream. However, it should be realized that this could be a 2-bit stream. The output of the analog modulator 10 on an output 12 is input to a digital filter/processing circuit 14. As will be described hereinbelow, the processing circuit 14 has internal thereto various FIR filter components that provide filtering and processing of the digital information. This is internally converted to a parallel word and then the digital values selected for various processing steps converted to a serial output stream for output on one of two serial outputs 16 and 18, labeled serial $D_{OUT1}$ and serial $D_{OUT2}$, respectively. Additionally, a configuration input is provided for configuring which of the various processing steps is applied to the digital data and on which output 16 or 18 the processed data is output.

Figure 2:
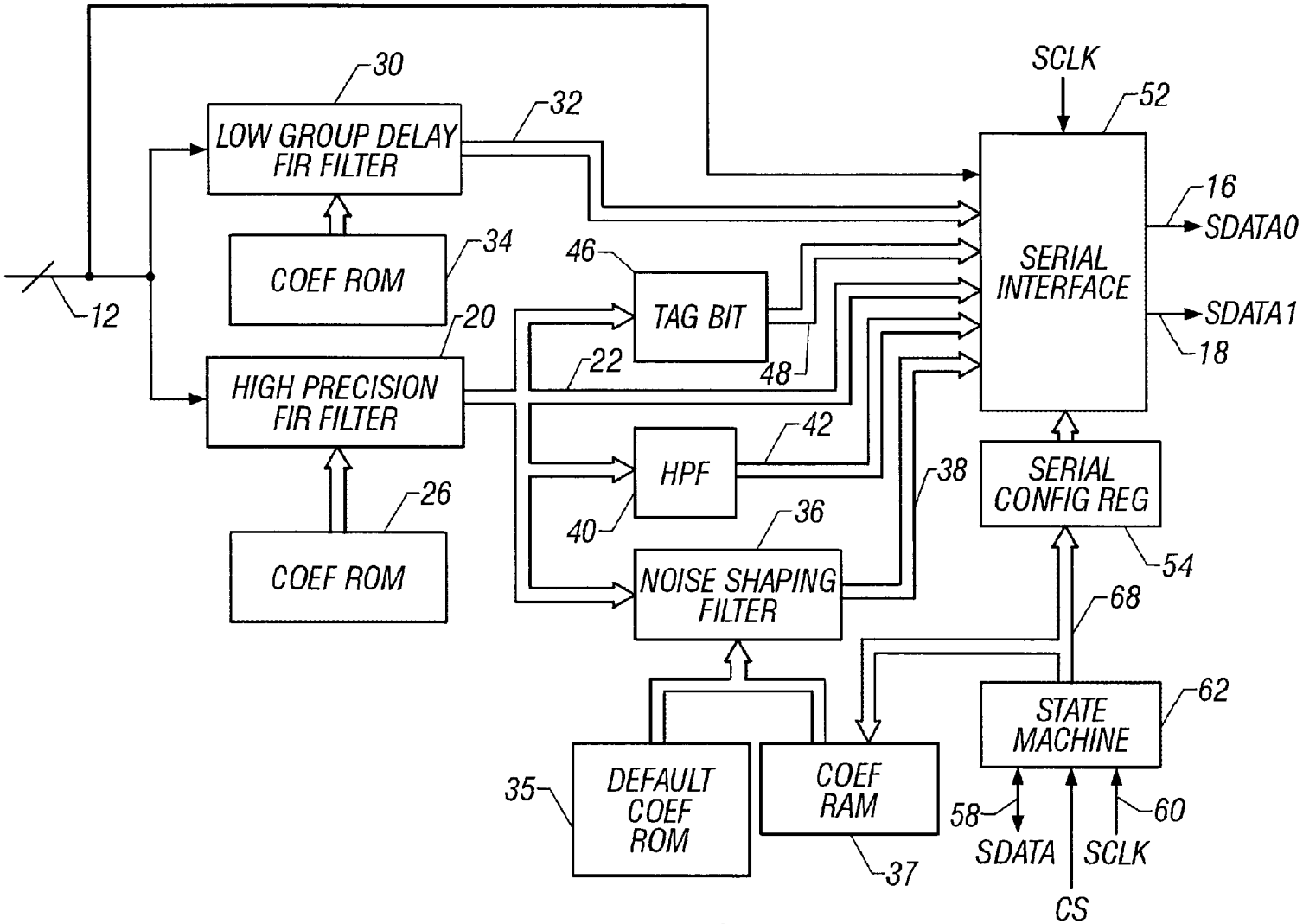
FIG. 2 illustrates a detailed block diagram of the digital filter/processing circuit.

Referring now to FIG. 2, there is illustrated a more detailed block diagram of the digital filter/processing circuit 14 of the present invention. The 1-bit digital stream on the line 12 is input to a high precision FIR filter 20 that is operable to process the 1-bit digital stream on line 12 through a filter function and output a digital word on an output bus 22. In the preferred embodiment, the bus 22 receives an output word 24 bits in length. The FIR filter 20 has a filter function that is a lowpass function, and implements a FIR filter with a length of 4096 taps. The coefficients for this filter are stored in a coefficient ROM 26. Additionally, the FIR filter 20 is a filter that has a variable bandwidth that utilizes the same set of coefficients. Although this is not discussed in detail in this application, this is described in U.S. patent application Ser. No. 08/413,356, filed Mar. 30, 1995, entitled, "DIGITAL FILTER WITH DECIMATED FREQUENCY RESPONSE". This system allows for selection of different bandwidth without providing for any recalibration of the system.

In addition to the high precision FIR filter 20, a low group delay FIR filter 30 is provided which receives on the input thereof the 1-bit digital stream of data on line 12 and provides on an output bus 32 a lower resolution than that output by the high precision FIR filter 20. The FIR filter 30 provides for a lower group delay through the use of a lower number of taps. In the preferred embodiment, as will be described hereinbelow, this is a filter of approximately 300 taps in length. As will also be described hereinbelow, this filter is also utilized for direct feedback to the user. As compared to the high precision FIR filter 20, the lower number of taps allows the information to be propagated therethrough with less delay. The coefficients for this FIR filter 30 are stored in the coefficient ROM 34.

The output of the high precision FIR filter 20 on the bus 22 can be further processed in a number of different ways. In one method, a noise-shaping filter 36 is provided for receiving the data word, truncating the word down to a 16-bit word, and shaping the output to reduce the noise in the optimal response portion of the spectrum of 2 KHz for a human and push the noise energy from this portion up into the higher and lower portions about the optimum portion. This is referred to as a psycho-acoustic filter. The output, as described above, is a lower resolution output of the order of 16 bits, which is output on a bus 38. The noise-shaping filter 36 has the coefficients thereof stored in a coefficient RAM 37, which coefficient RAM 37 allows for non-volatile storage in order for a user to input desired coefficients. As such, the coefficient RAM 37 allows the noise-shaping filter 36 to have the noise-shaping response thereof modified. An additional default coefficient ROM 35 is provided which provides for a default set of coefficients, which are utilized on startup. This default set of coefficients is typically those coefficients which are utilized on startup. This default set of coefficients is typically comprised of those coefficients associated with the response of the human ear; however, one could envision utilizing this with a different frequency response for customization purposes.

In addition to the noise-shaping filter 36, a high-pass filter 40 is provided for receiving the 24-bit output from bus 22 and outputting a filtered 24-bit data value on a bus 42. This is a conventional high-pass filter. The 24-bit output on bus 22 is also processed by a tag bit circuit 46 that is operable to select the LSB portion of the 24-bit data word on bus 22 for output on a bus 48 for level-meter display.

The buses 22, 32, 38, 42 and 48 are input to a serial interface device 52. Additionally, the 1-bit bus 12 is input to the serial interface device 52. The serial interface device 52 is operable to receive configuration data which is stored in a configuration register 54 and select one of the inputs thereto, convert it to serial data in accordance with a predetermined format, and output it on one of the serial data outputs 16 or 18. The other of the outputs 16 or 18 has one of the inputs to the serial interface device 52 selected for output thereon after conversion to a serial data stream in accordance with the serial data format.

Data is input to the system via a serial data input port 58 and a data clock 60. This is input to a state machine 62 which controls the overall configuration of the system and also the operation of the system. When data is input, it is converted to parallel data and stored in the serial configuration register 54 via a bus 68, which bus 68 also allows input of data to the coefficient RAM 37 with the appropriate signal associated therewith. Additionally, the state machine 62 is operable to control the various filters and the operations thereof.

Figure 3:
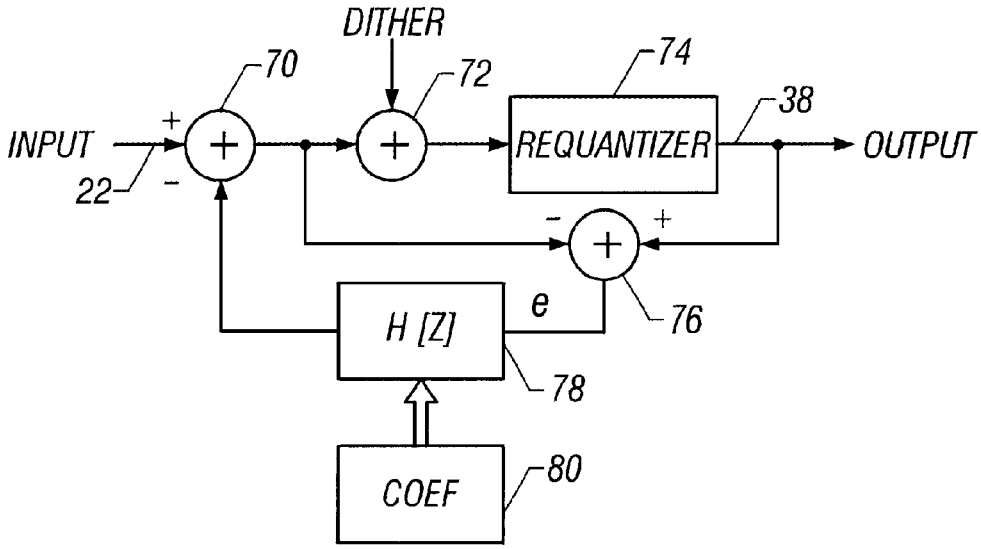
FIG. 3 illustrates a detailed block diagram of the noise-shaping filter.

Referring now to FIG. 3, there is illustrated a block diagram of the noise-shaping filter 36. The input to the noise-shaping filter is received from the bus 22, which is then input to a subtraction circuit 70. The output of subtraction circuit 70 is input to a summation circuit 72, which is operable to sum the output of the subtraction circuit 70 with a dither signal. This is then output to a requantizer 74, which requantizer 74 is essentially a truncation circuit operable to strip off the eight least significant bits from the 24-bit input word on bus 22 to provide on the output bus 38 a 16-bit word. The output of the requantizer 74, in addition to providing the output, also provides an input to a subtraction circuit 76, the negative input thereof connected to the output of subtraction circuit 70. This provides an error signal "e," which represents the error between the 16-bit word on bus 38 and the 24-bit word on the output of subtraction circuit 70. This is input to a filter 78 having a transform function of H(z). This is a FIR filter which has a coefficient ROM 35 associated therewith. After filtering, the output of the filter 78 is input to the negative input of the subtraction circuit 70. The filter 78 is operable to provide the appropriate shaping to the filter function. It is noted that the noise that is shaped is the truncation noise resulting from the quantizer circuit, and any noise shaping discussed hereinafter will refer to truncation noise with respect to the specific embodiments discussed herein. However, it is anticipated that other types of noise shaping algorithms can be utilized to shift noise from one portion of the frequency band to another and the description herein is not meant to limit the type of noise shaping that is to be utilized for this shifting operation.

Figure 4:
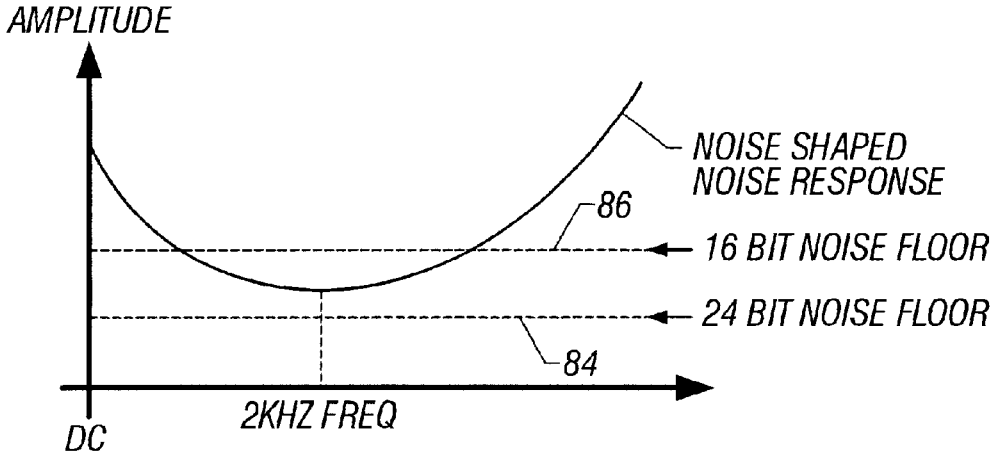
FIG. 4 illustrates a frequency diagram for the noise-shaping filter of FIG. 3.

With reference to FIG. 4, there is illustrated a frequency plot depicting the noise-shaping operation. Typically, the noise response on a 24-bit filter output is lower than that of a 16-bit filter output after truncation thereof. The 24-bit noise filter is represented by a dotted line 84 and the 16-bit noise filter is represented by a dotted line 86. It can be seen that the truncation error merely raises the noise floor across the frequency band. By utilizing the psycho-acoustic filter of FIG. 3, the truncation noise can be shaped such that it is reduced at a frequency of 2 KHz, but is increased at the low and high end of the band. The overall noise energy is the same or slightly higher, but the noise energy in the center portion around 2 KHz is translated to a higher frequency and a lower frequency. The operation of the psychoacoustic noise filter is described in U.S. Pat. No. 5,204,677, issued Apr. 20, 1993, and entitled "Quantizing Error Reducer for Audio Signal." This patent is incorporated herein by reference. Further, the psycho-acoustic filter is also described by Robert A. Wannamaker, "Pyscho-Acoustically Optimal Noise Shaping," Audio Engineering Society Convention, September 1990, with reference to FIG. 2, which reference is incorporated herein by reference. It is noted that the signal is not shaped; only the truncation noise is shaped.

It is important to note that in order to utilize a psycho-acoustic filter, that it is necessary to have the function of the requantizer 74. This requires that a higher resolution filter be utilized to generate a higher bit output. For example, it is necessary to generate a 24-bit output in order to optimize the truncation noise response with the psycho-acoustic filter and provide a 16-bit output.

Figure 5A:
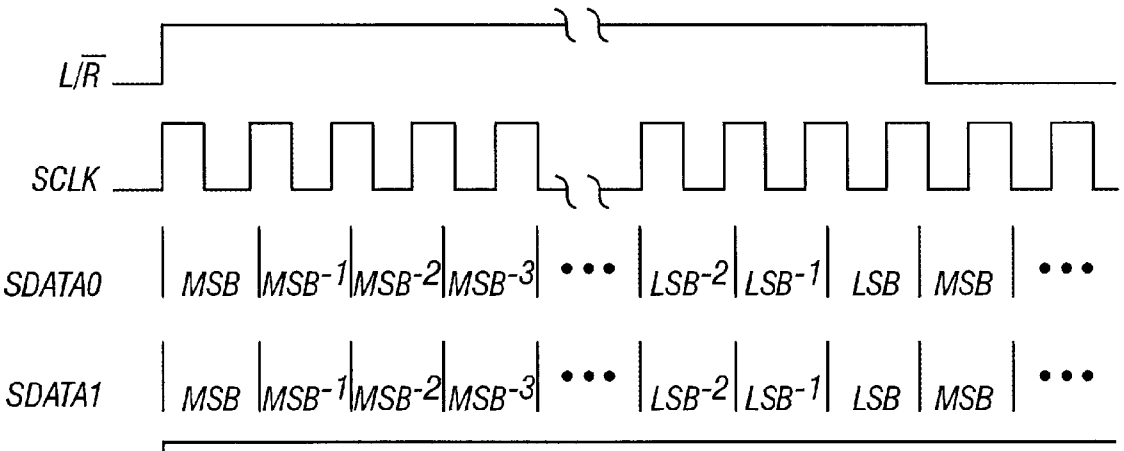
FIGS. 5*a* and 5*b* illustrate timing diagrams for the serial data output format.
Figure 5B:
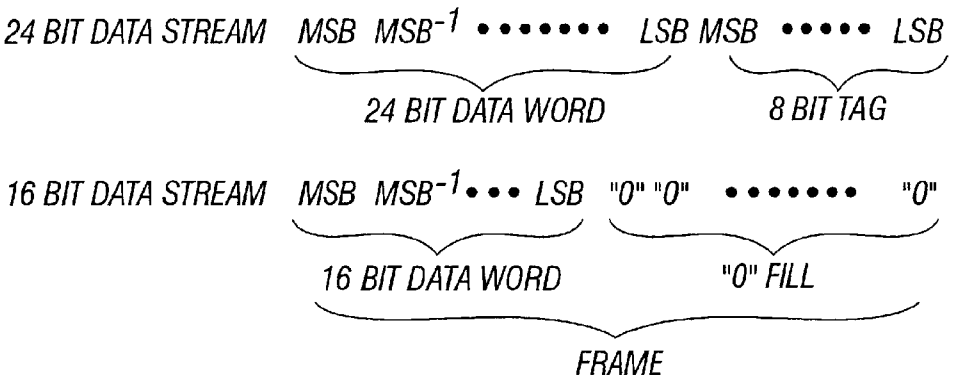
Figure 6:
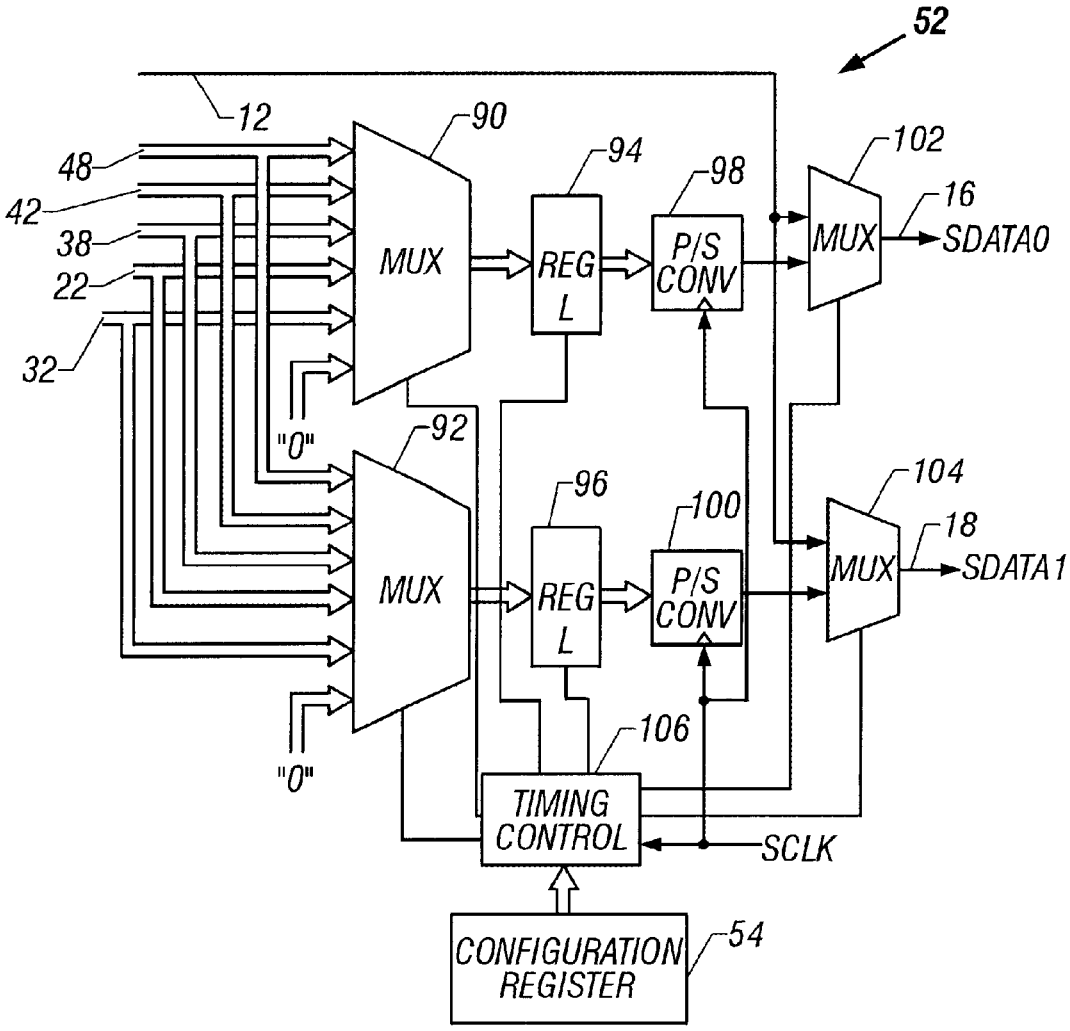
FIG. 6 illustrates a logic diagram for the serial output interface device.

Referring now to FIGS. 5*a* and 5*b*, there are illustrated timing diagrams for the format of the serial output data. With specific reference to FIG. 5*a*, the output is illustrated with the conventional left and right stereo outputs denoted by an L/R-BAR signal. When the signal is high, this indicates the left channel output and when the LYR-BAR signal is low, this indicates the right channel output. A serial clock is provided which has a frequency of 3.072 MHZ. The word rate on the output is 48 KHz. In order to have the 48 KHz output, it will require two 24-bit words to be output at the 48 KHz word rate. Each 24-bit word also has associated therewith the 8-bit tag word. Therefore, each frame associated with the left and right signal will have two 32-bit words for a total of 64 bits. This is illustrated in the SDATA0 and SDATA1 signals, which both have a 24-bit output associated therewith. It can be seen that each word is comprised of the most significant bits of the combined 24-bit word and the tag word as the LSB portion thereof. When the L/R-BAR signal goes low, this is repeated beginning with the MSB of the next combined 24-bit word and tag word. Each frame can be initiated with an FSYNC signal.

With specific reference to FIG. 5*b*, there is illustrated a comparison between the 24-bit data stream and the 16-bit data stream. The 16-bit data stream does not need a tag word. Therefore, each word will only require sixteen bits of the 16-bit data stream as compared to the thirty-two bits required for the 24-bit data stream. However, each word for both data streams must be output at the same word rate. To facilitate this, the 16-bit data stream is comprised of the 16-bit word, followed by a series of "zeroes" for a total of 64 bits for both the right and left channels.

Referring now to FIG. 61 there is illustrated a detailed block diagram of the serial interface device 52. The five buses, 22, 32, 38, 42 and 48 are input to two multiplexers 90 and 92. An additional input to each of the multiplexers 90 and 92 is a "0" input. The output of the multiplexer 90 is input to a latching register 94; the output of multiplexer 92 is input to a latching register 96. Register 94 has the output thereof connected to the input of a parallel-to-serial converter 98, and the output of register 96 has the output thereof connected to the input of the parallel-to-serial converter 100, Converter 98 provides a serial output that is input to one input of a two-to-one multiplexer 102, the other input thereof connected to the 1-bit input data bus 12. Similarly, the serial output of the converter 100 is connected to one input of the two-to-one multiplexer 104, the other input thereof connected to the input data bus 12. The output multiplexer provides the SDATA0 output 16 and the output of the multiplexer 104 provides the SDATA1 output 18.

A timing control 106 is provided that is operable to generate the various multiplexer select signals for multiplexets 90 and 92 and also multiplexers 102 and 104. The latching signals for the registers 94 and 96 are also controlled thereby. A serial clock signal SCLK is input to the timing control 106 and also to the clock input of the converters 98 and 100. The timing control 100 is controlled by the configuration register performing the control operations thereof in accordance with the information stored in the configuration 54. In operation, timing control device 106 is operable to control the multiplexers 90 and 92 to select one of the buses 22, 32, 38, 42 and 48. For example, if the output of bus 22 is selected for output on the SDATA0 output, multiplexer 90 will be controlled to select bus 22. If, at the same time, the output of the noise-shaping filter 36 is selected, bus 38 will be selected by multiplexer 92 for output on the SDATA1 serial output This will require the multiplexer 90 to select the bus 22 and input it to the register 94 during the first one-half of the frame represented by the L/R-BAR signal. At the same time, the 16-bit output on bus 38 will be selected for output from multiplexer 92 and latched into register 96. During the first half of the frame that the L/R-BAR signal is high, the multiplexer 90 will first latch the 24-bit word 20 on bus 22 into the register 94. This will then be processed by the converter 98 for twenty-four bits of the serial clock. During this time, the multiplexer 90 is controlled to select the tag word on bus 48 for input to the register 94. After the twenty-four bits of the data word on bus 22 have been processed by the converter 98, the tag word is then latched into register 94 and output to the converter 98 for conversion to the serial output. Also, during the first half of the frame when the L/R-BAR signal is high, the multiplexer 92 initially selects the 16-bit word on bus 78 for latching into the register 96. Once latched, multiplexer 92 then selects the "0" input. The converter 100 for the first sixteen bits of the frame, when L/R-BAR is high, will convert the contents of register 96 to a serial data stream. After the sixteenth bit, the selected "0" output will then be latched into the register 96, this being sixteen bits wide. These sixteen bits of "0" value will then be output in a serial format by the converter 100. During this time, the multiplexers 102 and 104 are operable to select the outputs of the converters 98 and 100% respectively. In the event that the contents of the serial bus 12 are selected, the appropriate one of the multiplexers 102 and 104 will select that output It is noted that this is a direct output for use in feeding back to the input level.

Figure 7:
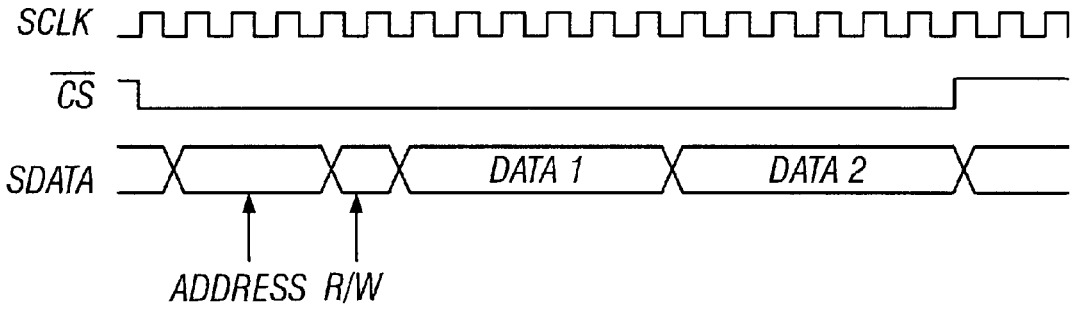
FIG. 7 illustrates a timing diagram for the data input/output operation.

Referring now to FIG. 7, there is illustrated a timing diagram for the data input operation. The data operation requires a serial data clock SCLK, a serial data stream input/output SDATA and a chip select input CS-Bar. This provides for asynchronous operation. Bringing CS-Bar low initiates the beginning of a frame. Thereafter, the first seven bits represent address bits. The next bit is a Read/Write bit. Following the Read/Write bit is a stream of 8-bit data words. When CS-Bar goes high, this indicates the end of a frame, and when CS-Bar goes go low again, another data input operation is initiated. For example, the noise-shaping filter response H(z) of the filter 78 can be obtained from either the default ROM 35 or from the coefficient RAM 37. The coefficients in the RAM 37 are downloaded from the SDATA signal on input port 58. This allows the user to program that function. Other internal registers can be utilized for configuration purposes.

Figure 8:
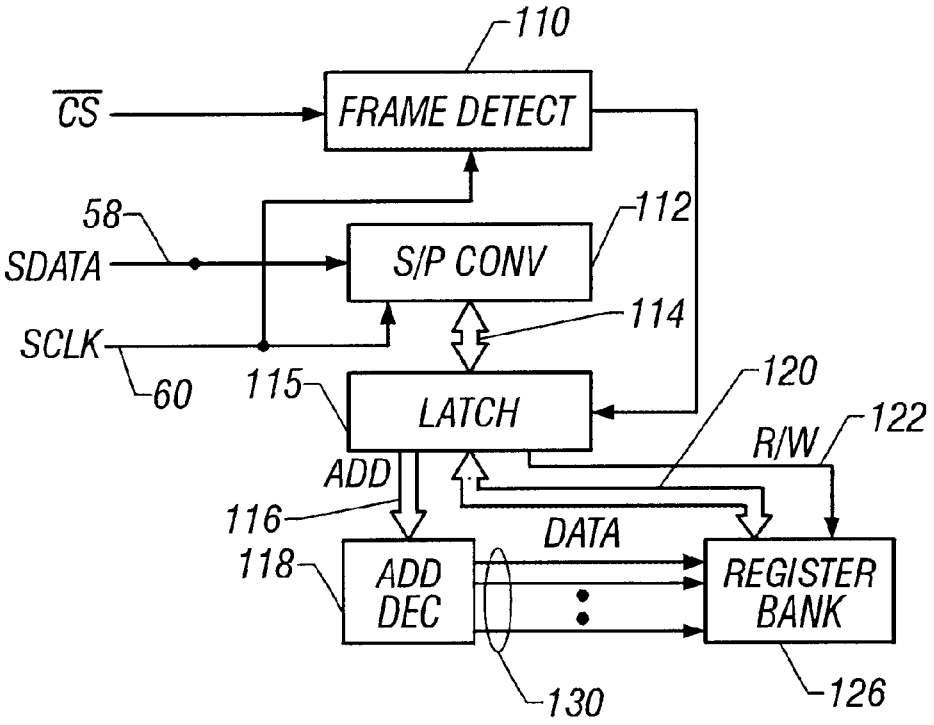
FIG. 8 illustrates a block diagram of the data input portion of the state machine.

Referring now to FIG. 8, there is illustrated a block diagram of the circuitry associated with the data input operation. The CS-Bar input is input to CS-Bar detect circuit 110, which also receives the SCLK signal. The CS-Bar detect circuit 110 is operable to detect a data communication operation. The data on serial bus 58, a bi-directional bus, is clocked into a serial-to-parallel/parallel-to-serial converter 112 during a Write operation which is operable to output a parallel data word on a bi-directional bus 114. The value of the data word on bus 114 continually changes as data is clocked in. At the appropriate time, the sequence of data is latched into a bi-directional latch 115 by the output from the CS-Bar detect circuit 110. Essentially, the CS-Bar detect circuit 110 detects the frame, and then sets an internal counter to count a predetermined number of clock cycles to ensure that the address bits, the R/W bit, and the data bits are shifted into the converter 112. At this time, the contents are latched in the latch 115 during the Write operation. Thereafter, a portion of the latch is output as the address on address bus 116 to an address decoder 118. The data portion of the information in the latch 115 is output on a bi-directional data bus 120. The R/W bit is output on a line 122. During a Read operation, the Read/Write bit and address bits are latched in the latch 115 and then the date transferred to the latch from the data bus 120 and then input to the parallel input of the converter 112. The data is then clocked out of the serial port of the converter 112 to the serial bus 58.

A register bank 126 is provided, which register bank 126 represents the serial configuration register 54, the coefficient RAM 37 and any other internal registers necessary to configure the system. The data bus 120 and R/W line 122 are input to the register bank 126. The address decoder 118 is operable to output a plurality of address lines 130 which are operable to select the appropriate one of the registers in the register bank 126 for storage of the data therein or retrieval of data therefrom.

Figure 9:
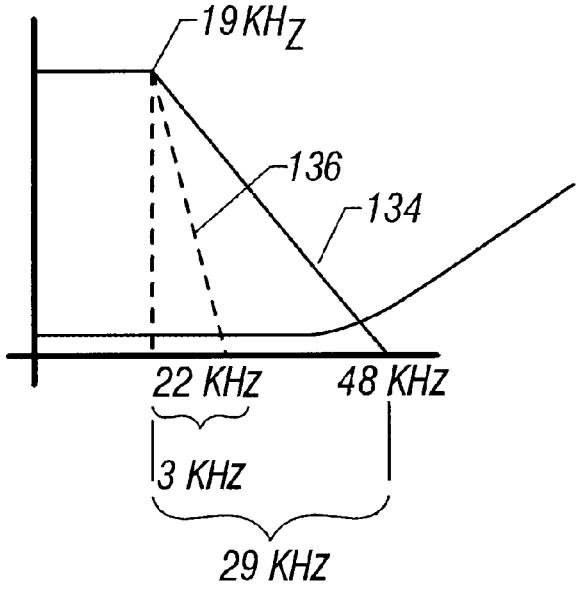
FIG. 9 illustrates a frequency diagram for the low group delay filter.

Referring now to FIG. 9, there is illustrated a frequency plot for the low group delay FIR filter 30. In order to provide a low group delay, it is necessary to minimize the number of taps required to realize the filter function. A typical filter function would require, for example, a 19 KHz break point or 3 dB rollover point, which would provide an acceptable attenuation at 22 KHz. This is approximately a 3 KHz transition band. This would provide an acceptable level of rejection for a lowpass filter with a conventional response curve for the output of the delta-sigma modulator 10. However, this would require a fairly complex filter with a large number of taps.

Typically, the response to a delta-sigma modulator is that associated with a lowpass filter, i.e., the out-of-band noise is higher than the in-band noise. To facilitate a smaller tap filter, the "sharpness" of the filter is reduced such that the acceptable attenuation occurs at 48 KHz as opposed to 22 KHz. This results in the ROM 34 which has a 29 KHz delta between the 19 KHz rollover and the 48 KHz point, as compared to a sharp filter represented by a dotted line 136. To facilitate the less sharp filter, the passband attenuation of the delta-sigma modulator 10 is extended out to 48 KHz. This utilizes the frequency response of the delta-sigma modulator 10 to provide some of the filtering. As such, the filter function of the low group delay filter 30 can be realized with a smaller filter on the order of 300 taps as opposed to a filter on the order of 2000 taps.

Figure 10:
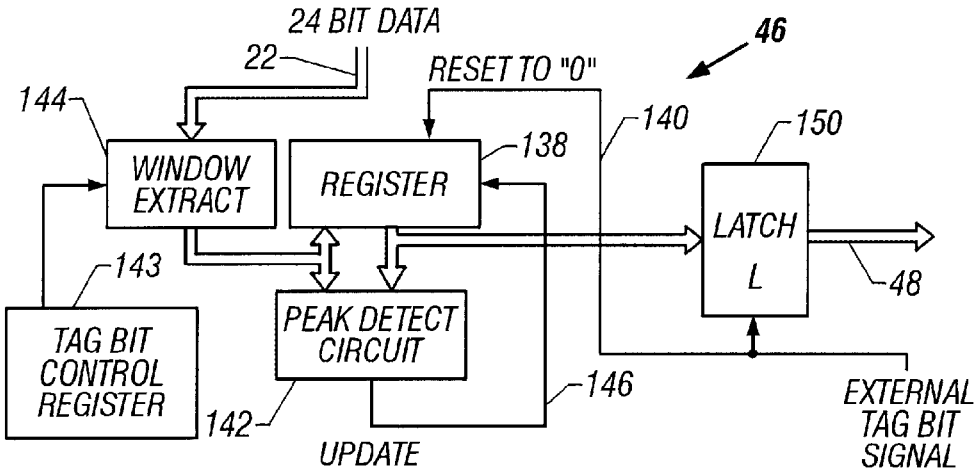
FIG. 10 illustrates a block diagram of the tag word device 46.

Referring now to FIG. 10, there is illustrated a block diagram of the tag device 46. The 24-bit data on bus 22 is input to an extraction circuit 144 which extracts a portion of the 24-Bit data word and inputs it to a register 138. This can provide a 1 dB resolution necessary for the tag word. The portion being extracted is controlled by a programmable tag bit control register 143. However, the 24-bit data word is output at a 48 KHz word rate and this is not required for the tag word. Rather, the tag word is utilized to drive a level meter. It is, therefore, only necessary to update this periodically and, for the purposes of output, it is only the peak value over a predetermined period of time that is necessary. The period of time that this value needs to be sampled is approximately two milliseconds. Therefore, every two milliseconds, the highest value for the tag word is required for output. To facilitate this, the register 138 is provided that has the output thereof initially set to zero by a reset line 140 and then the output thereof output to a peak detector circuit 142. The other input of the peak detector circuit 142 is connected to the 24-bit word on the data bus after extraction with the window extraction circuit 144, such that only a portion of the 24-bit word is input to the peak detector circuit 142. The peak detector circuit 142 will then generate an UPDATE signal on a line 146 for register 138 to latch a new value therein. This will only occur when the new value on the bus 22 is higher than the stored value in the register 138. Upon receiving the external signal on the line 140, the output contents on the register 138 are latched into a latch 150 and then the register 138 reset to a value of "0". The latch 150 will then provide the output on the bus 48.

Figure 11A:
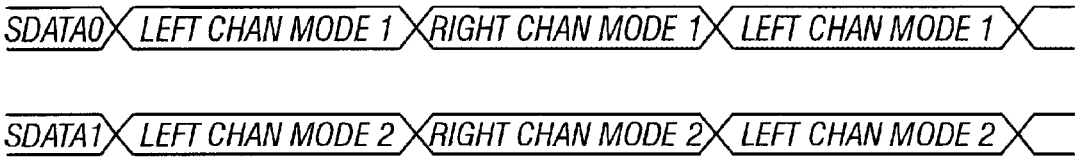
FIGS. 11*a* and 11*b* illustrates timing diagrams for two different arrangements for mixing the output channels in the two serial outputs.
Figure 11B:
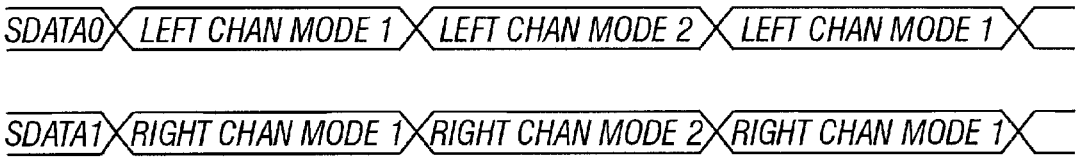

Preferring now to FIGS. 11*a* and 11*b*, there are illustrated timing diagrams for two different arrangements for mixing the output channels in the two serial outputs. In FIG. 11*a*, a first configuration is illustrated wherein two modes are provided for, a first mode and a second mode. The first mode Is associated with a select one of the digital processing circuits and the second mode is associated with another of the digital processing circuits or the same digital processing circuit associated with the first mode. The SDATA0 output is configured to output both left and right channels for the first mode and the SDATA1 serial output is configured to output both left and right channels for the second mode. In FIG. 11*b*, the SDATA0 output is configured to output the left channels of the first and second channels in an alternating fashion. The SDATA1 serial output is configured to output the right channels for both the first and second mode. It is noted that, in this configuration, the serial output must be able to output two different length words in an alternating manner.

Figure 12:
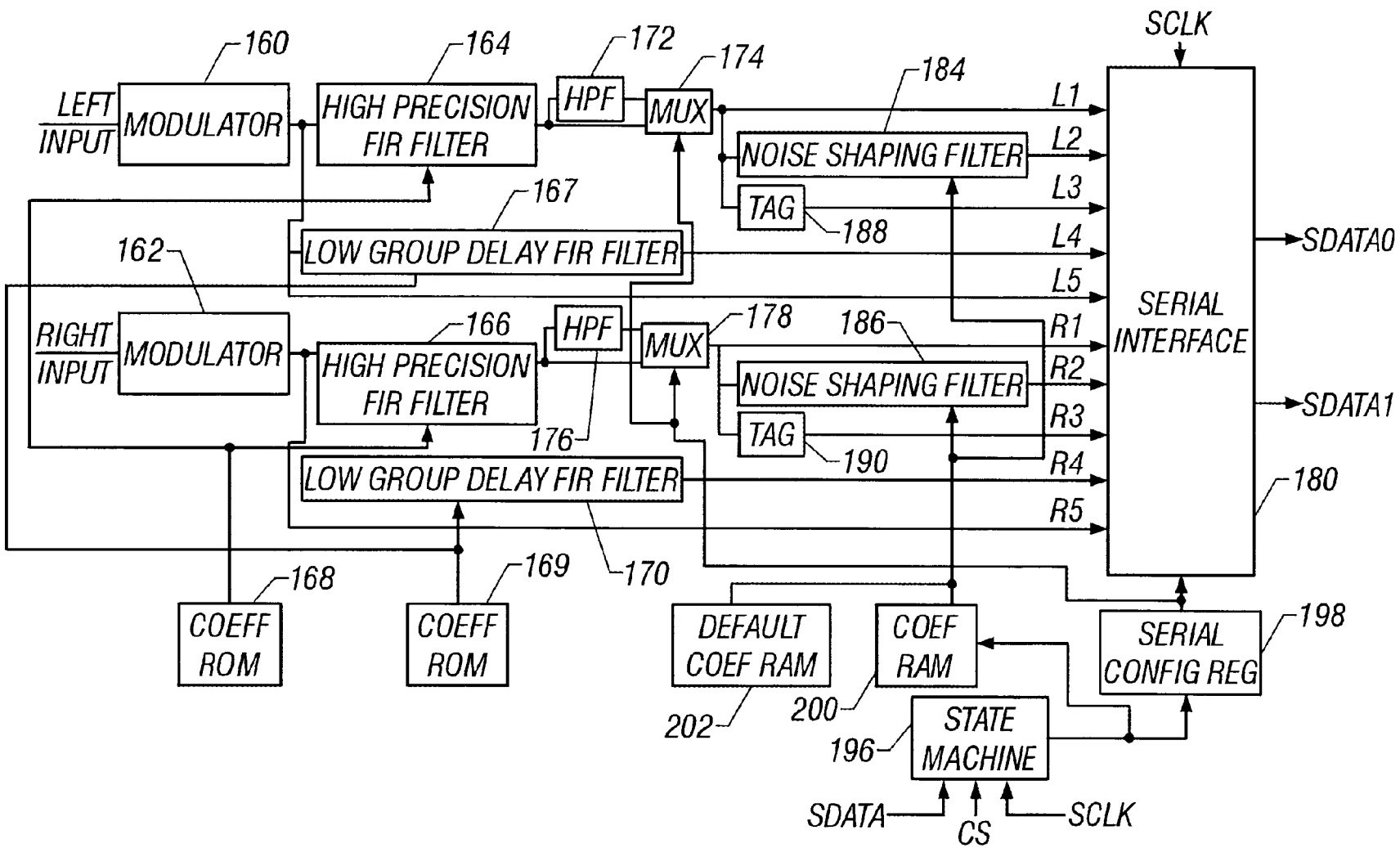
FIG. 12 illustrates a block diagram of a two channel analog-to-digital converter.

Referring now to FIG. 12, there is illustrated a block diagram of a two-channel analog-to-digital converter utilizing the serial outputs of the present invention. There are two inputs, a left input for a left channel of an audio program, and a right input for the right channel of the audio program. The left input is input to an analog modulator 160 and the right input is input to a modulator 162, modulators 160 and 162 being, in the preferred embodiment, delta-sigma analog modulators. However, they could be any type of data quantizer circuits. The output of modulator 160 is input to a high precision FIR filter 164, similar to the filter 20. Similarly, the output of modulator 162 is input to a high precision FIR filter 166. Both filters 164 and 166 are connected to a coefficient ROM 169, similar to coefficient ROM 36 of FIG. 2. The output of modulator 160 is also input to the input of a low group delay FIR filter 168 and the output of modulator 162 is input to a low group delay FIR filter 170, filters 168 and 170 similar to filter 30 of FIG. 2. Both filters 168 and 170 are connected to a coefficient ROM 169, similar to coefficient ROM 34 of FIG. 2.

The output of filter 164 is input to a high-pass filter 172 and also to the input of a multiplexer 174, the other input of multiplexer 174 connected to the output of the high-pass filter. Similarly, the output of filter 166 is connected to one input of a multiplexer 177, the other input thereof connected to the output of filter 176. Muliplexers 174 and 177 are controlled to select either the output of the respective ones of the filters 172 or 176 or the output of the respective ones of the filters 164 or 166. The output of multiplexer 174 comprises an L1 output, which is input to a serial interface device 180. The output of multiplexer 178 comprises an R1 input to interface 180. Additionally, the output of multiplexer 174 is input to the input of a noise-shaping filter 184, the output thereof comprising an L2 input to the interface 180. Similarly, the output of multiplexer 178 is connected to the input of a noise-shaping filter 186, the output thereof comprising an R2 input to interface 180. Filters 184 and 186 are similar to the filters 36 of FIG. 2. A tag device 188 has the input thereof connected to the output of multiplexer 174, the output thereof comprising an L3 input to interface 180. Similarly, a tag device 190 has the input thereof connected to the output of multiplexer 178, and the output thereof connected to an R3 interface to interface 180, tag devices similar to tag bit device 48 of FIG. 2. The output of the group delay filter 167 comprises an L4 input to Interface 180, and the output of group delay filter 170 comprises an R4 input to interface 180. The output of modulator 160 comprises an L5 interface to interface 180 and the output of modulator 162 comprises an R5 input to interface 180. Interface 180 provides two outputs, an SDATA0 output and an SDATA1 output.

A state machine 196 is provided, similar to state machine 62 of FIG. 2, for controlling the system, state machine 196 receiving an SDATA input, a Chip Select Bar input (CS-Bar) and a Serial Clock input (SCLK). The output of state machine 196 controls a serial configuration register 198, similar to register 54 of FIG. 2 and also has a data input connected to a coefficient RAM 200, which contains the operating parameters for the noise-shaping filters 184 and 186. Similarly, a default coefficient ROM 202 is provided, RAM 200 and coefficient ROM 202 similar to RAM 37 and ROM 35, respectively, of FIG. 2.

Figure 13:
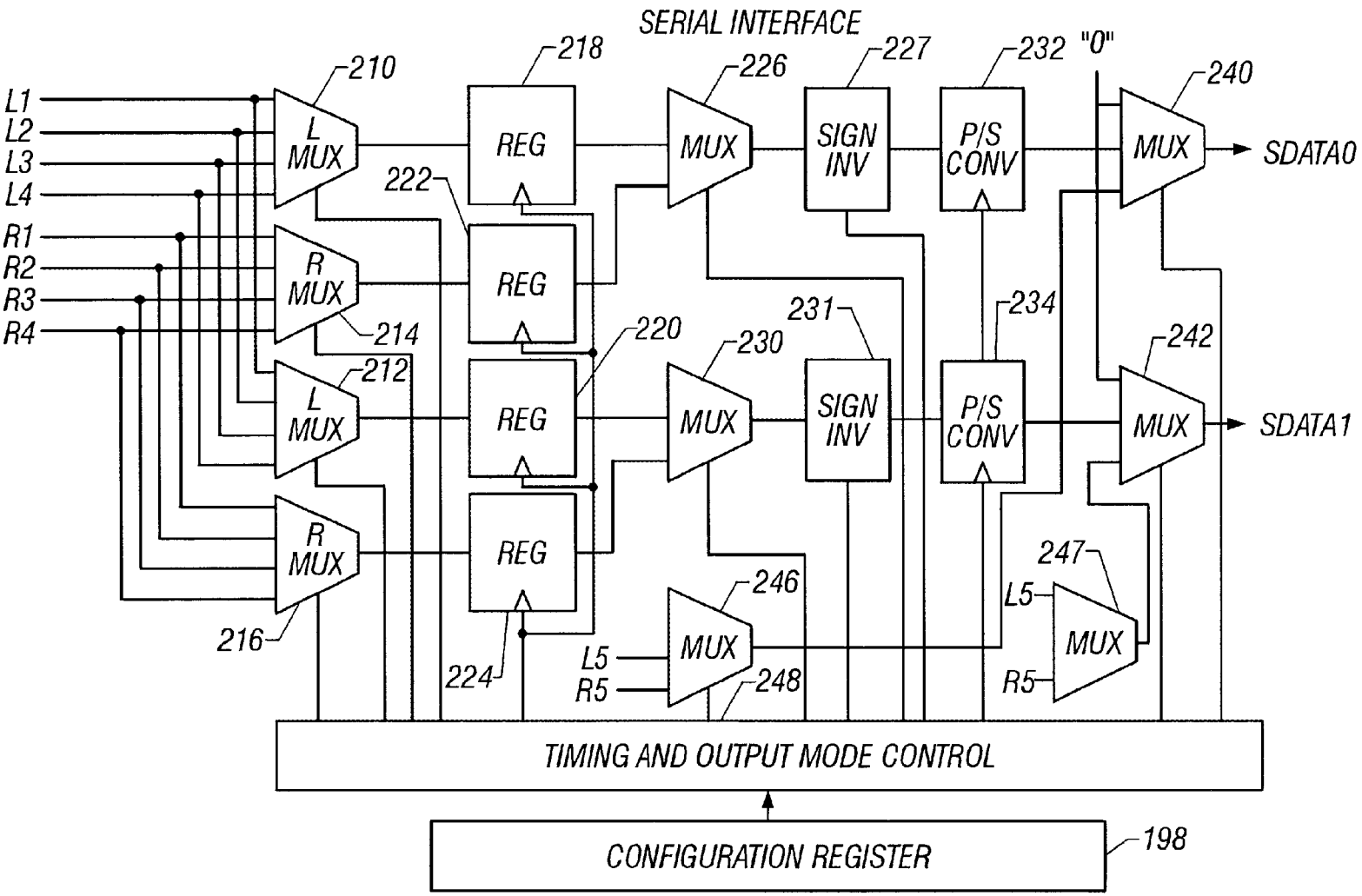
FIG. 13 illustrates a block diagram of the serial interface for the two channel analog-to-digital converter of FIG. 12.

Referring now to FIG. 13, there Is Illustrated a block diagram of the interface 180. The inputs L1–L4 are input to separate inputs of a four-input multiplexer 210 and also to separate Inputs of a four-input multiplexer 212. Similarly, the four inputs R1–R4 are connected to separate inputs of a four-input multiplexer 214 and also to separate inputs of a four-input multiplexer 216. The output of multiplexers 210–216 are connected to the inputs of respective latching registers 218, 220, 222 and 224. The output of registers 218 and 222 are connected to separate inputs of a two-input multiplexer 226, and the outputs of latching registers 220 and 224 are connected to separate inputs of a two-input multiplexer 230. The output of multiplexer 228 is connected to the input of a sign inversion device 227, the output thereof connected to the parallel input of a parallel/serial converter 232. The output of multiplexer 230 is connected to the input of a sign inversion device 231, the output thereof connected to the parallel input of a parallel/serial converter 234. The output of converter 232 is connected to one input of a three-input multiplexer 240, and the output of converter 234 is connected to one input of a three-input multiplexer 242. The L5 and R5 inputs are connected to separate inputs of two two-input multiplexers 246 and 247, the outputs thereof connected to inputs on each of the multiplexers 240 and 242, respectively. The remaining input of the multiplexers 240 and 242 are connected to a "0" value. The output of multiplexer 240 comprises the SDATA0 output, and the output of multiplexer 242 comprises the SDATA1 output.

All the multiplexers, converters and sign inversion devices described above with respect to FIG. 13 are controlled by a timing and output mode control device 248, which receives its input from the configuration register 198. In general, the operation of FIG. 13 is similar to that described hereinabove with respect to the serial interface 52, with the exception that it handles two separate channels and is operable to dispose any of the channels on any of the data outputs. In essence, there are now ten inputs instead of five inputs to be multiplexed. However, once the mode is determined, i.e., whether a particular digital processing device is selected, the system then determines whether it is the left or right channel that is output and how the left or right channel is output, this described above with respect to FIGS. 11*a* and 11*b*. The sign inversion devices 227 and 231 allow the system to selectively invert the sign of the stored value in the associated registers prior to output.

Figure 14:
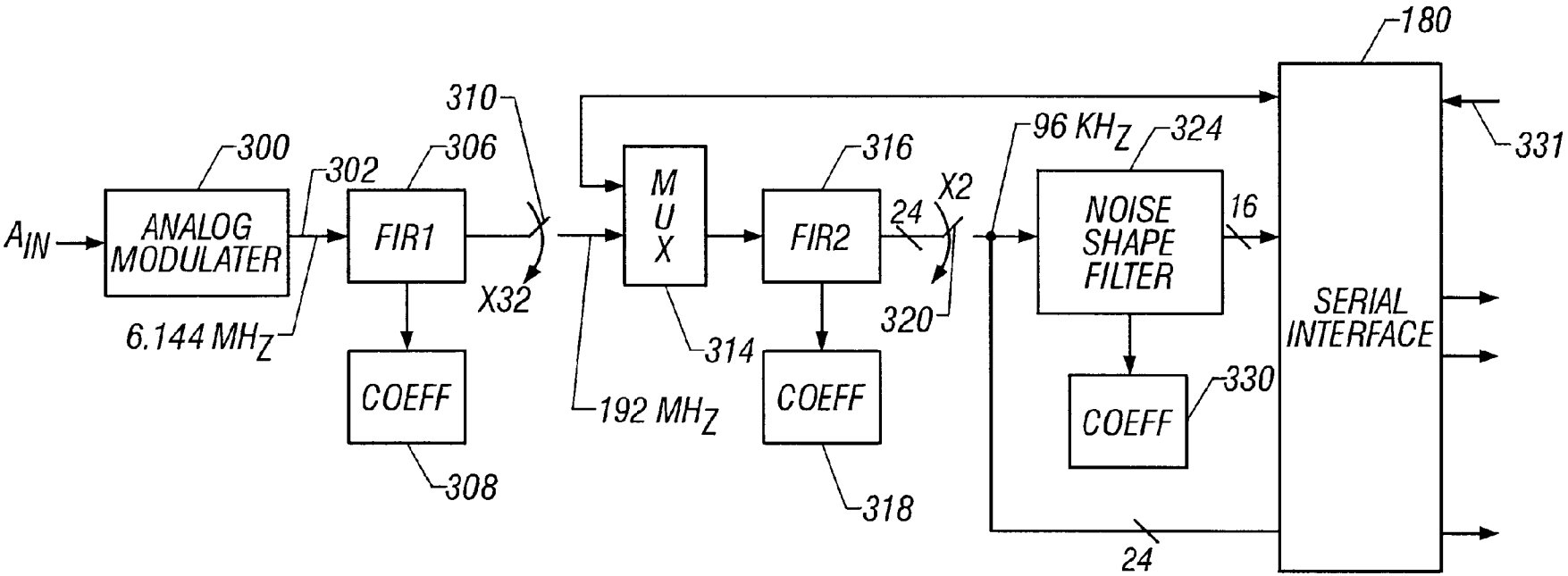
FIG. 14 illustrates the preferred embodiment of the present invention wherein an internal multiplexor is utilized to allow the filter to be utilized in a playback mode.

Referring now to FIG. 14, there is illustrated a block diagram of the preferred configuration for one channel of the analog-to-digital converter of FIG. 12. The analog input signal A is input to an analog modulator 300, which analog modulator 300 is a delta-sigma modulator, similar to either of the modulators 160 or 162. The output of the modulator 300 is a single bit digital output operating at a sample rate of 6.144 MHz in the preferred embodiment on a line 302. This, as described above with respect to FIG. 12, is then filtered with a digital filter. In this embodiment of FIG. 14, the filters 164 and 166 are each divided into two stages. A first stage is provided by a finite impulse response (FIR) filter 306 having a coefficient set 308 associated therewith. Associated with the FIR filter 306 is a decimation circuit 310, the decimation 310 operable to decimate the output of the filter 306 by a factor of 32. Therefore, the output of the overall filter/decimation operation will be a filtered signal at a sampling rate of 192 KHz, which is input to one input of a multiplexer 314. The output of the multiplexer 314 is input to a second FIR filter (FIR2) 316, which also has a coefficient set associated therewith in a block 318. The output of the FIR2 filter 316 again is a 24-bit output that is decimated by a decimation circuit 320 by a factor of 2 to provide on the output thereof a 96 KHz signal, the overall decimation of the two filters 306 and 316 being 64.

The filtered output of the decimation circuit 320 is then input to a noise-shaping filter 324 or directly to the serial interface block 180. The serial interface block 180 in the embodiment of FIG. 14 is provided with an additional output, as will be described hereinbelow. The noise-shaping filter 324 has a coefficient set associated therewith in a coefficient block 330. The noise-shaping filter 324 is similar to the psycho-acoustic filter of FIG. 4, which was described in detail hereinabove. However, the noise-shaping filter 324 does not have a coefficient set that results in an inverse A-weighting function; rather, it is designed to shift all of the truncation noise in one portion of the frequency band of operation to a higher portion of the band. This will be described in more detail hereinbelow.

Figure 15:
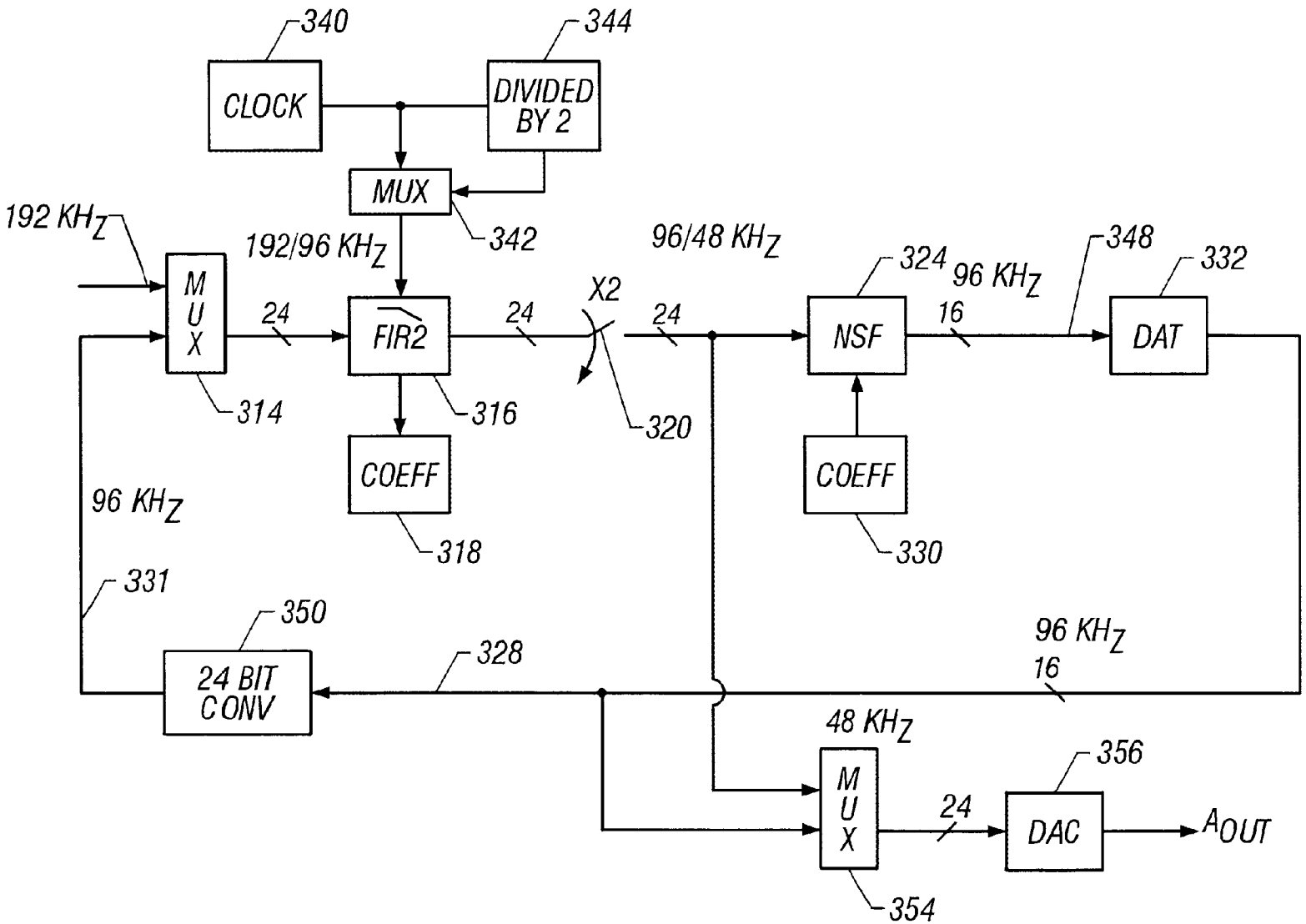
FIG. 15 illustrates the external connection for a digital audio tape during a playback and record operation.

When the integrated circuit associated with the embodiment of FIG. 12 and the preferred embodiment of FIG. 14 is utilized in a record/playback operation, it is connected as illustrated in FIG. 15. With specific reference to FIG. 16, the multiplexer 314, the FIR2 filter 316 and the noise-shaping filter 324 are illustrated in more detail. Additionally, the serial interface 180 is illustrated as connecting the output noise-shaping filter 324 to a Digital Audio Tape (DAT) 332, which DAT 332 is operable to store digital data with a 16-bit word length and at a sampling rate of 96 KHz. The output of the DAT is connected to the line 331, which comprises the input line 328 to the other input of the multiplexer 314. However, it should be understood that any type of digital storage media could be utilized.

The FIR2 filter 316 has a clock 340 associated therewith which has the output thereof connected to one input of a multiplexer 342 and also connected through a divide-by-two circuit 344 to the other input of the multiplexer 342. The multiplexer 342 is operable to select a divided down clock rate, such that the FIR2 filter 316 can be operated at half speed for a playback operation, as will be described in more detail hereinbelow.

In the first operation, the system is configured for a record operation. In this operation, the 192 KHz sampling rate signal input to the multiplexer 314 provides a 24-bit 192 KHz signal to the FIR2 filter 316, which FIR2 filter 316 is a lowpass filter. In the record mode, the multiplexer 342 selects the direct output of the clock 340, such that the FIR2 filter 316 is operating at full speed. This will provide on the output of the FIR2 filter 316 a 96 KHz signal which is decimated by a factor of 2, with the decimation circuit 320 providing a 96 KHz signal for input to the noise-shaping filter 324 during the record operation. The noise-shaping filter 324, as described above, will receive the 24-bit input, truncate the 24-bit word by performing the noise-shaping operation of the truncation noise, and then output a noise-shaped 16-bit word on a line 348 to the input of the DAT 332. Again, the serial interface 180 is eliminated for simplicity purposes. By utilizing a 16-bit word, the level of storage in the DAT 332 can be increased, as compared to storing a 24-bit word. However, the audible spectral information is maintained, in that the DAT still operates at 96 KHz.

In a playback operation, one goal is to provide a 48 KHz signal at a 24-bit word length with a noise response that exceeds that of a 16-bit word. As will be more clearly described hereinbelow, this is the result of the manner in which the truncation noise is shaped and subsequently filtered and decimated.

With further reference to FIG. 15, during the playback operation, the 96 KHz 16-bit word is output from the DAT 332 and input to the other end of the multiplexer 314 on line 328. This 16-bit word is converted to a 24-bit word by a block 350 which essentially adds eight "0's" to the least significant bits, such that a 24-bit 96 KHz signal is input to the other end of the multiplexer 314 and then output therefrom to the FIR2 filter 316. In this mode, however, multiplexer 342 selects the output of the divide-by-two circuit 344, such that the FIR2 filter 316 is operating at half speed. In this mode, it will now handle a 96 KHz signal, provide the lowpass filter operation thereon, and then output to the decimation circuit 320 the filtered signal which will then be decimated to a 24-bit word at a 48 KHz sampling rate. This will be output to one input of a multiplexer 354, which outputs a 24-bit word to a 48 KHz Digital-to-Analog Converter 356 to provide on the output an analog signal $A_{out}$. Alternatively, the multiplexer 354 could select the direct output of the DAT 332 for input to the DAC 356, wherein the DAC 356 would have to operate at a 96 KHz rate. However, conventional DACs do not currently operate at that frequency, such that some type of decimation-by-two circuit will be required for a 48 KHz DAC.

It can be seen with the embodiments of FIGS. 14 and 15 that the DAT 332 can be utilized to store digital information at a 96 KHz rate and then utilize the same filter 316 that was utilized in the record operation for a playback operation to provide the decimation-by-two operation for the 48 KHz signal for operation with the DAC 356. However, in addition to the decimation-by-two operation utilizing the same filter for both the record and the playback operation, the system of this embodiment of the invention also provides for storage of the data on the DAT 332 at a 16-bit word length with the input to the DAC 356 being a 24-bit word length, with the noise response being improved over that of the 16-bit word that was stored in the DAT 332.

Figure 16:
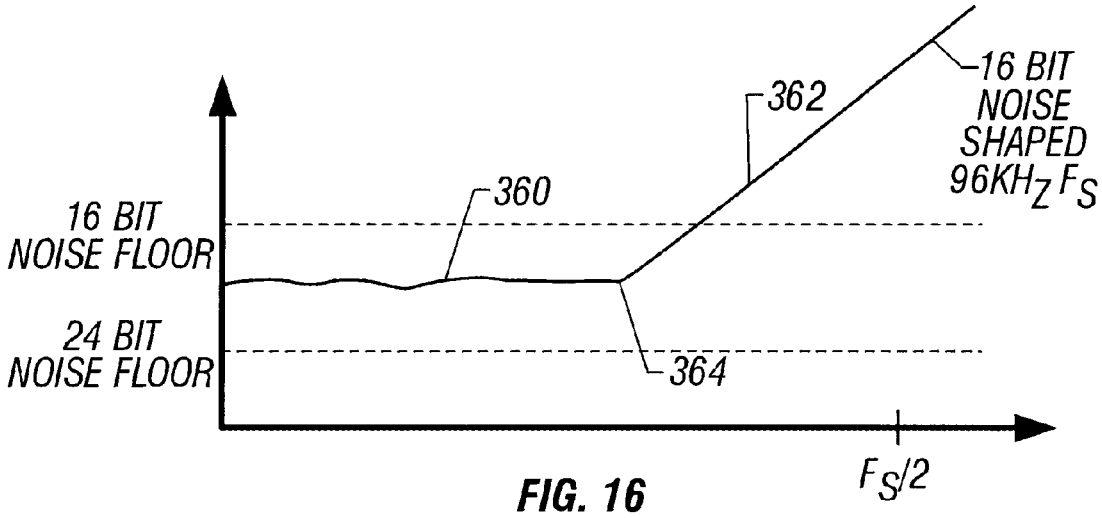
FIG. 16 illustrates a plot of the noise-shaped 16-bit response at the 96 KHz sampling rate stored on the digital media.

With reference to FIG. 16, there is illustrated a plot of the frequency response of the noise that is output by the noise-shaping filter 324. When the data is input to the noise-shaping filter 324, it is initially input at the 24-bit word length with a 20-bit noise floor, in that a 20-bit noise floor is the practically realizable noise floor level for a 24-bit analog-to-digital converter. However, when dealing with a 16-bit word length, the dynamic range is less and this is represented by a 16-bit noise floor due to an increase in the truncation noise. Of course, the 20-bit noise floor is much lower than the 16-bit noise floor. Therefore, it is inherent that a 16-bit word length will have associated therewith a higher overall truncation noise level and a lower dynamic range than the 24-bit word length when stored on the DAT 332.

With the conventional use of the psycho-acoustic filter, as described hereinabove, the actual audible noise can be improved by taking advantage of the response of the ear in that truncation noise in the center part of the audible spectrum can be shifted to the lower and upper portions, such that a perceived improvement can be made. However, the overall average noise power has not been reduced; rather, it has been shifted into a different portion of the band.

In this embodiment of the present invention, the noise-shaping filter for shaping the truncation noise within the operating band is utilized to provide a response that is essentially flat in a region 360 of the frequency plot of FIG. 16 and then increases in a region 362 above a corner frequency 364. This filter response will occur in the frequency range below $f_s/2$. Since the 16-bit noise-shaped signal was stored at a sampling frequency of 96 KHz, $f_s/2$ is at a frequency of 48 KHz. The corner frequency 364 is selected to be approximately 24 KHz such that the region below 24 KHz is relatively flat. It is noted that the response in the region 360 is relatively flat, and is not an inverse A-weighted curve, as is typical with a psycho-acoustic filter. This flat region has the noise floor essentially the same as a 24-bit converter. The reasons for this will be described hereinbelow.

Figure 17:
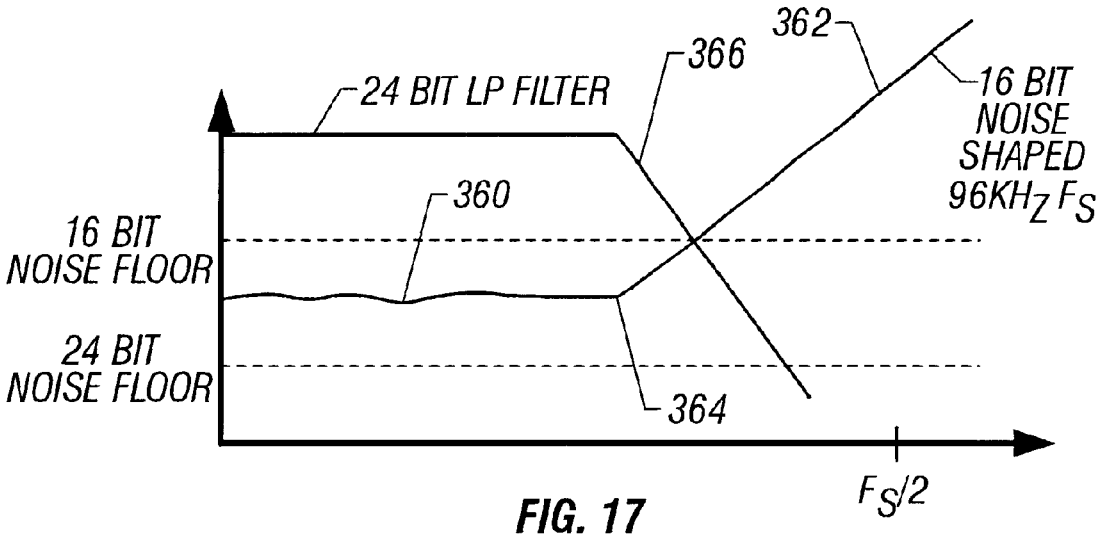
FIG. 17 illustrates the filtering operation during the playback operation.
Figure 18:
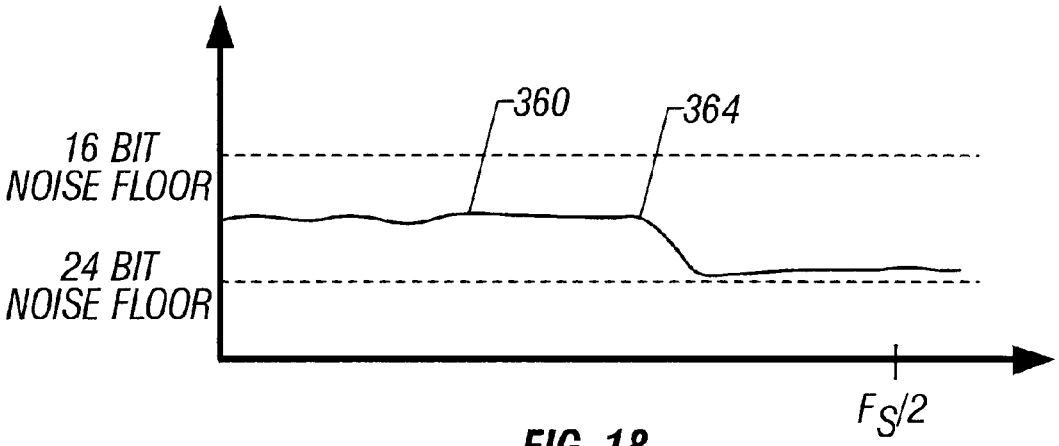
FIG. 18 illustrates the filtered waveform prior to decimation.

Referring now to FIG. 17, there is illustrated a plot of a lowpass filter response 366 that effectively filters out the noise that was shifted from the region 360 up to the region 362. This is filtered at a 24-bit word length such that, once filtered, the output above the point 364 should be at a level coincident with the 20-bit noise floor, with some adjustments made for processing thermal noise, etc. (This filter operation also filters out signal.) This response is illustrated in FIG. 18. It can be seen that the noise response is now less than that of the 16-bit noise floor, and the noise above the corner frequency 364 has effectively been attenuated. As such, a stored 16-bit signal has now been processed such that the inherent truncation noise associated therewith has been reduced below the 16-bit noise floor by subsequent processing of the preprocessed signal. Therefore, the 96 KHz 24-bit signal which was recovered from the 16-bit 96 KHz signal now has an overall noise level that is lower than that which was inherently stored. This is due to the noise-shaping filter and the fact that it did not utilize an inverted A-weighted response but, rather, a response which shifted truncation noise from the region 360 into the region 362, which region 360 was coincident with that of the pass band in the low pass filter response 366 of the FIR2 filter 316. It is then only necessary to perform a decimation-by-two operation to output the signal at a 48 KHz sampling rate at a 24-bit word length, such that the noise floor has now been improved over that of a conventional 16-bit signal. This will allow for use of a 48 KHz DAC 356. However, if a 16-bit 96 KHz DAC 356 were utilized, its noise response in the audible region would be lower than that associated with a non noise-shaped signal.

It can be seen that the portion 360 in FIG. 16 between zero and $f_s/4$ has a substantially flat response and is basically in the audible range from 0 through 24 KHz. By noise-shaping the response and the shifting of the truncation noise from portion 360 to portion 362, the noise has been significantly improved in the audible range. However, it is noted that the low pass filtering operation described with respect to FIG. 17 removes the noise that was shifted up into region 362, but it also removes the signal contained therein. Therefore, if there were any useful information in the portion of the frequency spectrum above 24 KHz, this would also be attenuated. To insure that further noise is not inserted, the filtering must be done at a word length greater than 16-bit; 24-bit in the present embodiment. This insures that the noise shifted from region 360 to region 362 prior to storage in the DAT 332 will not increase substantially. By converting the 16-bit noise shaped signal at 96 KHz to the 24-bit word length and then filtering it at or above the 24-bit word length, the actual audio information initially stored in the region 360 can be recovered and played back. This information can be played back at either 96 KHz utilizing an appropriate digital-to-analog converter or at a 48 KHz rate as set forth in the present embodiment. Of course, if the playback occurred at 96 KHz, this would require a different operation than described hereinabove with respect to FIG. 9 in that the decimation step on the output of the filter 316 of FIGS. 14 and 15 would not be required. This would require a different architecture which is not described herein. Of course, a 16-bit 96 KHz DAC could be utilized to receive the direct output of the DAT, with the only problem being that the truncation noise shifted to the upper portion of the band would now be added to the signal in that portion of the band and would be audible, if the listener could actually process that information. The important aspect, however, is the reduction of noise in the audible portion of the frequency band of operation by noise shifting from within the audible band to a location outside the audible band and subsequent filtering of the portion of the frequency spectrum outside of the audible band.

Figure 19:
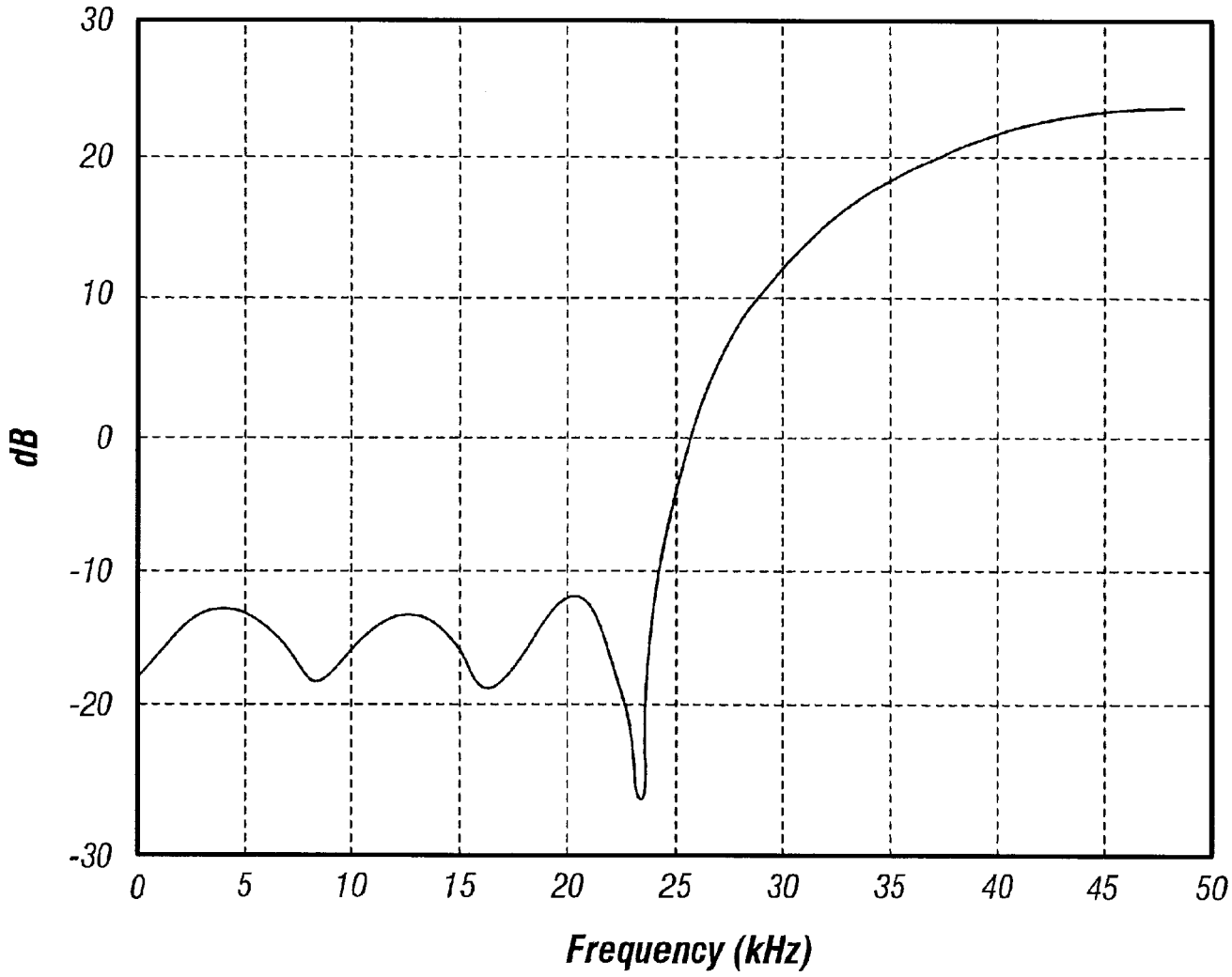
FIG. 19 illustrates a detailed plot of one example of the noise-shaped waveform with a sampling frequency of 96 KHz and an $f_s/2$ of 48 KHz.

Referring now to FIG. 19, there is illustrated a frequency plot of an example of a noise-shaping response. The zero dB level represents the thermal noise floor for a 16-bit signal. It can be seen that the noise has been reduced by approximately 15 dB at the peak of the ripple response in the pass band. Therefore, an increase of 15 dB in the dynamic range has been realized, while still allowing for storage of the data in a 16-bit word length.

In summary, there has been provided a method for storing data in a digital medium at a high sample frequency with a 16-bit word length and recovering that data at a higher word length with an improved noise performance over that inherently associated with a 16-bit word length. This is facilitated by noise shaping the stored data at the 16-bit word length by shifting the noise upward in the spectrum prior to storage thereof. The data is then retrieved, converted to a higher word length and a lowpass filter utilized to filter out the shifted noise. This will result in an overall decrease in the recovered signal which can then be input to a digital-to-analog converter for conversion to an analog signal.

Although the preferred embodiment has been described in detail, it should be understood that various changes, substitutions and alterations can be made therein without departing from the spirit and scope of the invention as defined by the appended claims.

What is claimed is:

1. A digital audio system for storing digital audio data on a digital audio media as stored audio information and retrieving the stored digital audio data in a playback operation, comprising:

a first date conversion device for converting an audio input signal to a digital audio signal with a noise response at a first sampling rate and at a first word length and operating over an associated frequency band;

a noise shaping device for noise shaping the noise response of the digital audio signal to shift noise from a low portion of the frequency band thereof to a higher portion of the frequency band thereof;

an output device for outputting the noise shaped digital audio signal to the digital audio media for storage thereon;

an access device for retrieving the stored noise shaped digital audio signal from the digital audio media; and a second data conversion device for converting the retrieved noise shaped digital audio signal to an audio signal such that the noise shifted to the higher portion of the frequency band is not in the audible range, said second data conversion device including a low pass filter for low pass filtering the retrieved noise shaped digital audio signal at a word length greater than said first word length to remove noise in the higher portion of the frequency band of the digital audio signal in addition to the associated audio signal thereat wherein a sharpness of the low pass filter is reduced by extending a passband attenuation of the low pass filter so that fewer taps are required for the low pass filter.

2. The system of claim 1, wherein said noise shaping device operates so as to noise shape the noise response without substantially affecting the signal associated therewith.

3. The system of claim 2, wherein said noise shaping device includes a truncation device to truncate a digital audio signal at a second word length longer than said first word length to said first word length and then noise shape the truncation noise associated with said truncation operation.

4. The digital audio storage media of claim 3, wherein the level of the truncation noise of the lower portion from which the noise is shifted is lower than the level of the truncation noise inherently associated with the second word length.

5. The digital audio storage media of claim 1, wherein the frequency response of the stored audio information is non-weighted.

6. The digital audio storage media of claim 1, wherein the lower portion from which the noise is shifted has a substantially flat response relative to overall noise level.

7. A digital audio system for storing digital audio data on a digital audio media and retrieving the stored digital audio data in a playback operation, comprising:

a first data conversion device for converting an audio input signal to a digital audio signal at a first sampling rate and at a first word length and having a noise response and operating over an associated frequency band;

a noise shaping device for noise shaping the noise response of the digital audio signal to shift noise from a lower portion of the associated frequency band thereof to a higher portion of the associated frequency band thereof;

an output device for outputting the noise shaped digital audio signal to the digital audio media for storage thereon;

an access device for retrieving the stored noise shaped digital audio signal from the digital audio media;

a word length conversion device for converting the retrieved noise shaped digital audio signal to a converted digital noise shaped signal with a second and longer word length at the first sampling rate;

a first digital low pass filter for filtering the converted digital noise shaped signal at the second word length to attenuate the shifted noise in the higher portion of the associated frequency band of the digital audio signal at the first sampling rate, in addition to the audio signal associated thereat, and provide a filtered converted noise shaped digital audio signal wherein a sharpness of the first digital low pass filter is reduced by extending a passband attenuation of the first digital low pass filter so that fewer taps are required for the first digital low pass filter; and a digital-to-analog converter operating at the first sampling rate for converting the filtered converted noise shaped digital audio signal at the second word length to an analog output signal.

8. The system of claim 7, further comprising a decimation circuit for decimating the filtered converted noise shaped digital audio signal to a second sampling frequency lower than said first sampling frequency and operating said digital-to-analog converter at the lower and second sampling frequency.

9. The system of claim 7, wherein said first data conversion device comprises:

an analog modulator for converting the audio input signal to a digital stream having noise associated therewith that is shifted to a predetermined portion of the frequency band associated with the digital audio signal; and a second digital filter for filtering the output of said analog modulator to attenuate said shifted noise.

10. The system of claim 9, wherein said analog modulator comprises a delta-sigma analog modulator.

11. The system of claim 9, wherein said second digital filter operates at or above said second word length and said noise shaping device includes a truncation device for truncating said signal output by said second digital filter at said second word length to said first word length.

12. The system of claim 11, further comprising a multiplexer for multiplexing the operation of said second digital filter operating at said second word length to perform the function of said second digital filter and said first digital filter, and operating at said second word length, such that only a single digital filter is required.

13. The system of claim 7, wherein said first digital low pass filter comprises a low pass digital filter having a passband attenuation frequency that is increased from a generally normal 22 Khz frequency to a 48 Khz frequency.

14. The system of claim 7, wherein said noise shaping device comprises a noise-shaping digital filter that is operable to truncate the noise response of the digital audio signal input thereto and shift truncation noise from a first portion of the frequency band of said digital audio signal to a second and higher portion thereof, such that said first portion is in the audible range.

15. The system of claim 14, wherein the frequency response of said noise-shaping digital filter in said first portion is substantially flat with a noise level that is lower than the theoretical noise level associated with said first word length.

16. A digital audio storage media having audio information stored thereon in a digital format operating over an associated frequency band and at a first word length at a first sampling rate with an associated noise response that is shaped to shift a portion of the noise from a lower portion of the frequency band to an upper portion of the associated frequency band without substantially affecting the information associated therewith, such that the lower portion from which the noise is shifted is in substantially the entire audible region and wherein the noise is filtered by a low pass filter having a sharpness that is reduced by extending a passband attenuation of the low pass filter so that fewer taps are required for the low pass fitter.

17. The digital audio storage media of claim 16, wherein the frequency response of the stored audio information is non-weighted.

18. The digital audio storage media of claim 16, wherein the portion of the frequency band between the lower portion from which the noise is shifted and the upper portion to which the noise is shifted is approximately the first sampling rate divided by a factor of four.

19. The digital audio storage media of claim 16, wherein the lower portion from which the noise is shifted has a substantially flat response relative to overall noise level.

20. The digital audio storage media of claim 16, wherein the level of the noise of the lower portion from which the noise is shifted is lower than the level of the noise inherently associated with the first word length.

21. A digital audio system for storing digital audio data on a digital audio media for later retrieval of the stored digital audio data in a playback operation, comprising:

a first data conversion device for converting an audio input signal to a digital audio signal with an associated noise response at a first sampling rate and at a first word length and operating over an associated frequency band;

a noise shaping device for noise shaping the noise response of the digital audio signal to shift noise from a low portion of the frequency band thereof to a higher portion of the frequency band thereof such that the portion of the frequency band from which the noise is shifted is substantially in the entire audible region;

a low pass filter for low pass filtering the noise shaped digital audio signal when retrieved at a word length greater than said first word length to remove noise in the higher portion of the frequency band of the digital audio signal in addition to the associated audio signal thereat wherein a sharpness of the low pass filter is reduced by extending a passband attenuation of the low pass filter so that fewer taps are required for the low pass filter; and an output device for outputting and storing the noise shaped digital audio signal to the digital audio media.

22. The system of claim 21, wherein said noise shaping device includes a truncation device for truncating said noise shaped signal at said first word length to a second word length.

23. The system of claim 21, wherein said noise shaping device comprises a noise-shaping digital filter that is operable to truncate said digital audio signal and shift truncation noise from a first portion of the frequency band of said digital audio signal to a second and higher portion thereof, such that said first portion is in the audible range.

24. The system of claim 23, wherein said noise-shaping digital filter has a frequency response in said first portion that is substantially flat with a noise level that is lower than the theoretical noise level associated with said first word length.

25. A digital audio system for retrieving stored digital audio data from a digital audio media in a playback operation and converting the stored digital audio data to an analog signal, the digital audio signal stored on the digital audio media being at a first sampling rate and at a first word length and operating over an associated frequency band with the noise response shaped to shift noise from a low portion of the frequency band thereof to a higher portion of the frequency band thereof without substantially affecting the signal associated therewith, comprising:

an access device for retrieving the stored noise shaped digital audio signal from the digital audio media;

a word length conversion device for converting the retrieved digital audio signal to a second and longer word length at the first sampling rate;

a first digital low pass filter for filtering the converted digital noise shaped signal at the second word length to attenuate the shifted noise in the higher portion of the frequency band at the first sampling rate in addition to the audio signal associated therewith wherein a sharpness of the first digital low pass filter is reduced by extending a passband attenuation of the first digital low pass filter so that fewer taps are required for the first digital low pass filter; and a digital-to-analog converter operating at the first sampling rate for converting the filtered converted noise shaped digital audio signal at the second word length to an analog output signal.

26. The system of claim 25, further comprising a decimation circuit for decimating the filtered converted noise shaped digital audio signal to a second sampling rate lower than said first sampling rate and operating said digital-to-analog converter at the second sampling rate.

27. The system of claim 25, wherein said first digital low pass filter comprises a low pass digital filter having a passband attenuation frequency that is increased from a generally normal 22 Khz frequency to a 48 Khz frequency.

28. The system of claim 25, wherein noise-shaped digital audio signal has the truncation noise associated therewith shifted from a first portion of the frequency band thereof to a second and higher portion thereof, such that said first portion is in the audible range.

29. The system of claim 28, wherein the frequency response of the noise-shaping digital audio signal in said first portion is substantially flat with a noise level that is lower than the theoretical noise level associated with said first word length.

30. A method for storing data on a digital audio media as stored audio information and retrieving the stored digital audio data In a playback operation, comprising the steps of:

converting an audio input signal to a digital audio signal with a noise response at a first sampling rate and at a first word length and operating over an associated frequency band;

noise shaping the digital audio signal to shift noise from a low portion of the associated frequency band thereof to a higher portion of the frequency band thereof;

storing the noised shaped digital audio signal on the digital audio media;

retrieving the stored noise-shaped digital audio signal from the digital audio media;

converting the retrieved digital audio signal to a second and longer word length at the first sampling rate;

low pass filtering, by a low pass filter, the converted digital noise-shaped signal at the second word length to remove the shifted noise in the higher portion of the associated frequency band at the first sampling rate wherein the step of low pass filtering further comprises the step of reducing a sharpness of the low pass filter by extending a passband attenuation of the low pass filter so that fewer taps are required for the low pass filter; and processing the filtered converted noise-shaped signal through a digital-to-analog converter operating at the first sampling rate and at the second word length.

31. The method of claim 30, further comprising the step of decimating the filtered converted noise-shaped digital audio signal to a lower sampling rate and then operating the digital-to-analog converter at the lower and second sampling rate.

32. The method of claim 30, wherein the step of converting the audio signal to a digital audio signal comprises:

converting the audio input signal to a digital audio stream with an analog modulator having noise associated therewith that is shifted to a predetermined portion of the band; and digitally filtering the output of the analog modulator to remove the shifted noise.

33. The method of claim 32, wherein the analog modulator comprises a delta-sigma analog modulator.

34. The method of claim 32, wherein the step of digitally filtering operates at the second word length and the step of noise shaping is preceded by an additional step of truncating the filtered signal at the second word length to the first word length.

35. The method of claim 34, further comprising the step of multiplexing the operation of a single digital filter for both the step of digitally filtering and the step of filtering the converted noise-shaped signal such that only a single digital filter is required, with both steps of digitally filtering and filtering the converted noise-shaped signal operating at the second word length.

36. The method of claim 30, wherein the step of filtering the converted noise-shaped signal with a digital filter comprises filtering the converted noise-shaped digital signal with a low pass digital filter.

37. The method of claim 30, wherein the step of noise shaping comprises processing the digital audio signal to shift noise from a first portion of the frequency band to a higher portion thereof.

38. The method of claim 37, wherein the step of filtering the noise-shaped digital audio signal wherein the first portion of the digital audio signal has a substantially flat response having a noise level substantially lower than the noise level associated with said first word length.

* * * * *